United States Patent [19]

Honda et al.

[11] Patent Number: 4,816,630

[45] Date of Patent: Mar. 28, 1989

[54] PUSH-BUTTON SWITCH WITH PLUNGER AND SWITCH MECHANISM

[75] Inventors: Sueaki Honda, Kurayoshi; Mitsuji Hayashi, Nagaokakyo; Takashi Niwa; Akihiko Hayakawa, both of Kyoto; Hideyuki Bingo, Uji, all of Japan

[73] Assignee: Omron Tateisi Electronics Co., Japan

[21] Appl. No.: 67,391

[22] Filed: Jun. 26, 1987

Related U.S. Application Data

[63] Continuation of Ser. No. 816,619, Jan. 6, 1986, abandoned.

[30] Foreign Application Priority Data

| | | | |
|---|---|---|---|
| Jan. 8, 1985 | [JP] | Japan | 60-1304[U] |
| Jan. 8, 1985 | [JP] | Japan | 60-1305[U] |
| Jan. 9, 1985 | [JP] | Japan | 60-1337[U] |
| Jan. 9, 1985 | [JP] | Japan | 60-1338[U] |

[51] Int. Cl.[4] ..... H01H 9/18; H01H 13/46

[52] U.S. Cl. ..... 200/314; 200/153 J; 453/523

[58] Field of Search ..... 200/153 J, 314, 284, 200/67 A, 67 R, 313, 310, 317

[56] References Cited

U.S. PATENT DOCUMENTS

| | | | |
|---|---|---|---|
| 2,441,614 | 5/1948 | Baumer | 200/153 J |
| 2,723,389 | 11/1955 | Hallenberg et al. | 200/314 |
| 2,749,415 | 6/1956 | Davis | 200/153 J |
| 2,890,387 | 6/1959 | Wiley et al. | 200/153 J X |
| 3,394,403 | 7/1968 | Dennison | 200/314 |
| 3,437,775 | 4/1969 | Piber | 200/314 |
| 3,511,955 | 5/1970 | Frank et al. | 200/314 |
| 3,602,663 | 8/1971 | Jones | 200/67 B |
| 3,965,320 | 6/1976 | Ditzig | 200/314 |
| 3,983,348 | 9/1976 | Kellogg | 200/314 |
| 4,004,120 | 1/1977 | Lee | 200/310 |
| 4,129,764 | 12/1978 | Ohkita et al. | 200/159 R |
| 4,194,104 | 3/1980 | Stenta | 200/153 J |
| 4,268,735 | 5/1981 | Iwakiri | 200/314 |
| 4,350,857 | 9/1982 | Fillus et al. | 200/314 |
| 4,354,078 | 10/1982 | Yoshimura | 200/314 |
| 4,359,618 | 11/1982 | Stevens | 200/314 |
| 4,398,075 | 8/1983 | Vogel | 200/314 |
| 4,431,879 | 2/1984 | Fujita et al. | 200/314 |
| 4,447,685 | 5/1984 | Ohashi et al. | 200/153 J X |
| 4,495,391 | 1/1985 | Kitao et al. | 200/153 J |

*Primary Examiner*—Henry J. Recla
*Assistant Examiner*—Ernest G. Cusick
*Attorney, Agent, or Firm*—Wegner & Bretschneider

[57] ABSTRACT

A push-button switch having a lamp portion and a switch portion. The lamp portion includes a lamp, a lamp holder, a lamp casing, and a housing. The lamp holder is fixed within the housing and the lamp casing moves up or down to turn off or turn on the switch. The switch portion of the push-button switch includes a switch base, a plunger, and a cam. The plunger moves in conjunction with the lamp casing and has a cam formed on one end. The cam is guided along guides that are formed on the switch base, and holds the lamp casing and plunger in a raised position in which the switch is turned off and a lowered position in which the switch is turned off.

5 Claims, 10 Drawing Sheets

Fig. 2
Fig. 2(b)
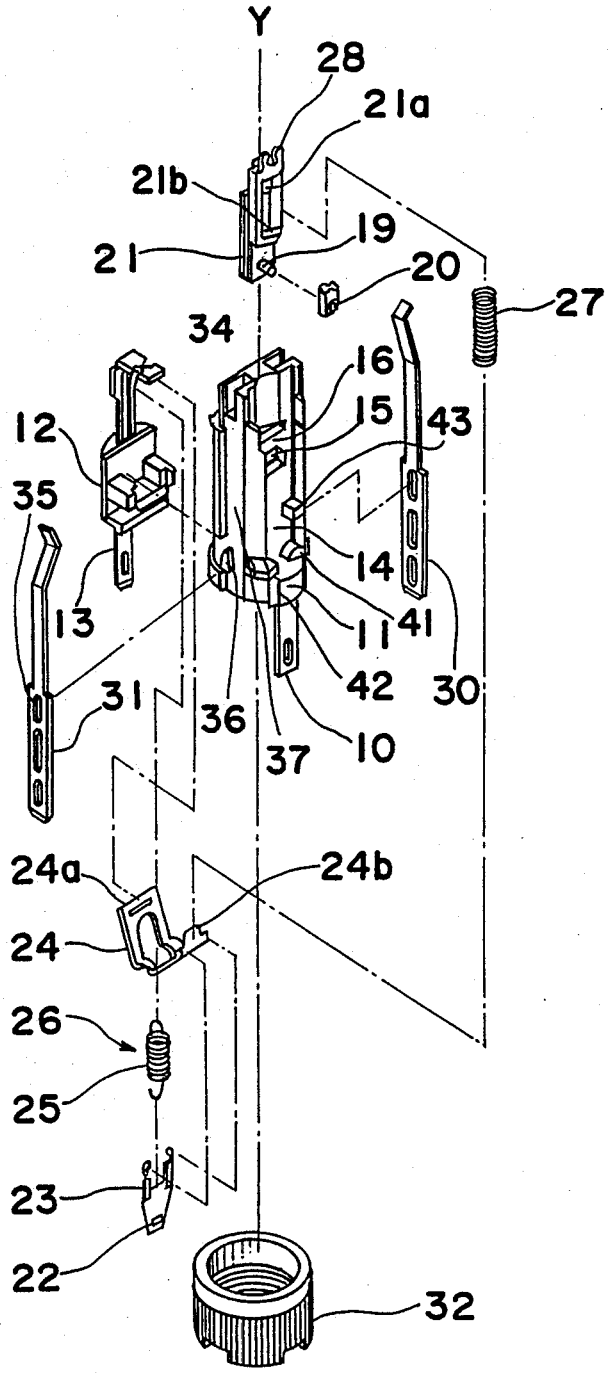
Fig. 2(a)
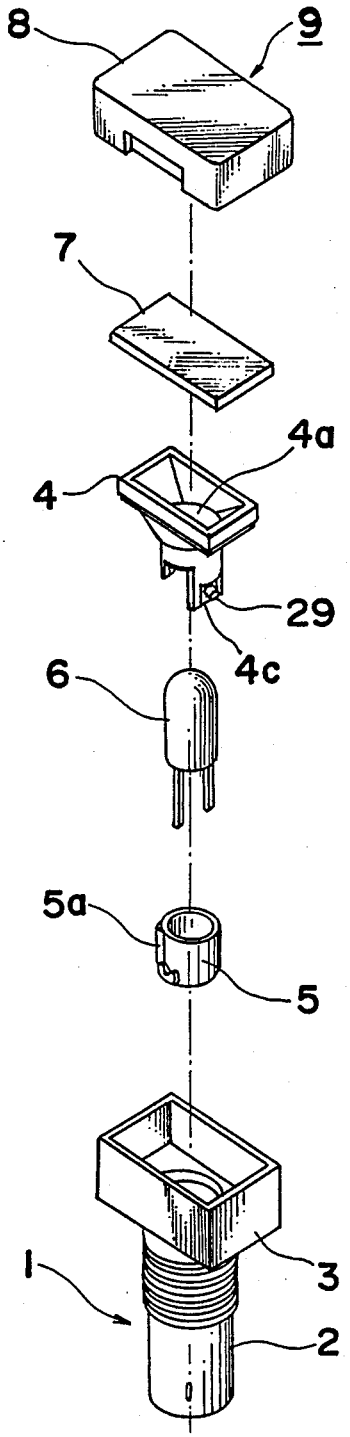

PUSH-BUTTON SWITCH WITH PLUNGER AND SWITCH MECHANISM

This application is a continuation of U.S. application Ser. No. 816,619, filed Jan. 6, 1986, now abandoned.

BACKGROUND OF THE INVENTION

The present invention generally relates to a push-button switch employed for controlling the supply of electricity in various kinds of electronic appliances such as an audio instrument, etc.

Generally, as a push-button switch of the type referred to above, such one as is equipped with an illumination unit which accommodates a light emitting element like a light emitting diode, etc. therein has been well-known. More speciically, the prior art push-button switch is so constructed that a light emitting diode LED is held by a lamp holder which is accommodated within a lamp casing, and at the same time the lamp casing is covered by a covering through a light diffusion disk, thereby forming an operation unit actuated in association with the depressing operation of the switch. In this prior art switch, since the operation unit is arranged to be engaged with a plunger, the switching mechanism is controlled to be turned on or off by the depressing operation of the operation unit, through the plunger, simultaneously with which the LED is illuminated.

However, since the aforementioned LED has polarity, and therefore is likely to be improperly inserted into the lamp holder. That is, the LED is likely to be inserted into the holder backwards so that the polarity of the LED is reversed and no light is emitted.

The illumination unit as described above is generally composed of a light emitting element, a holder which holds the light emitting element inside thereof, a lamp casing for accommodating the holder therein, and a light diffusion disk provided on the lamp casing through a covering.

These components are generally formed into the illumination unit so as to be installed in a housing which is a main body of the push-button switch. However, when the illumination unit is depressed within the range of a given stroke, both the LED and the holder should be moved upwards and downwards relatively to each other within the lamp casing while they are secured to the housing. Moreover, each of these component parts such as the LED and holder is considerably small in size, and therefore, it is inconvenient that some tool, for example, a pair of pincers is required in assembling the component parts.

SUMMARY OF THE INVENTION

Accordingly, a first object of the present invention is to provide an improved push-button switch which can prevent a lamp holder, a lamp casing and a plunger from being inserted improperly, such tht the polarity of the LED is not reversed.

A second object of the present invention is to provide an improved push-button switch of the type referred to above in which both an illumination unit comprised of a light emitting element, a holder, a lamp casing, etc. and a housing can be assembled without the use of any tool such as a pair of pincers or the like.

A third object of the present invention is to provide an improved push-button switch of the type referred to above in which an operating member is arranged to be engaged to a fixed terminal, instead of a particular engaging element, during the temporary assembling of the switch, which fixed terminal in turn prevents the operating member from being disengaged therefrom thereby achieving smooth assembly of the switching mechanism and improving the efficiency of the assembly alike.

A fourth object of the present invention is to provide an improved push-button switch of the type referred to above which can realize smooth movement of an alternate cam.

In accomplishing these and other objects, according to the present invention, a push-button switch is formed with a U-shaped projection on the outer peripheral surface of a lamp holder which holds illumination elements thereon, and at the same time, it is formed with a recessed portion, corresponding to the above projection, on the inner surface of a lamp casing which accommodates the lamp holder therein. Further, a projected shaft is formed on the outer face of the lamp casing so as to be engaged with an engaging portion at one end of a plunger. Thus, the illumination elements having polarity such as an LED, etc. can be set in a predetermined direction and prevented from being improperly inserted, as is the case with the prior art push-button switch. Moreover, in the push-button switch of the present invention, while the U-shaped projection is engaged to the recessed engagement portion, a housing in which the lamp casing is accommodated in such a manner as to be able to be depressed by a given stroke is integrally formed with a forked engaging portion which engages the U-shaped projection from opposite sides thereof. After the lamp holder the light emitting element thereinside is accommodated in the lamp casing, and the lamp casing is installed at a predetermined position in the housing, the lamp holder is moved in the casing and then the U-shaped projection on the outer peripheral surface of the lamp holder is brought into engagement with the engaging projection in the lamp casing. Therefore, the lamp holder is restricted in its movement. At the time when the lamp holder is stopped, the forked engaging portion of the housing is engaged with the U-shaped projection of the lamp casing from opposite sides thereof. Accordingly, no special tool such as a pair of pincers or the like is necessary for the assembly of the push-button switch of the present invention. In the push-button switch of the present invention, a shouldered portion to be engaged with the operating member is formed at a curved corner of a fixed terminal in an inversed L-shaped configuration. On the other hand, a through-hole passing through the fixed terminal is formed at one end of the operating member. Accordingly, when the operating member is engaged to the curved corner of the fixed terminal through the through-hole, the opposite side edges of the through-hole come into contact with the shouldered portion, thereby preventing the operating member from being disengaged in the upward direction or in the downward direction. Moreover, since it is so arranged that the spring force is added during the temporary assembling time, the operating member is prevented from being disengaged in the forward direction or in the backward direction. Accordingly, the operating member is never disengaged from the fixed terminal during the temporary assembly. Further, since it is so designed according to the present invention that the edge of the through-hole formed at one end of the operating member is engaged with the fixed terminal, no separate and special engaging member is necessary as would be required in the prior art push-button switch. Additionally, while a switching base is integrally formed with a sliding portion of a plunger, which plunger is pivotally provided with an alternate cam, the sliding portion is integrally formed with guides of the alternate cam. Therefore, the guides can be placed with high accuracy relative to the sliding portion, thus achieving smooth and accurate movement of the alternate cam.

BRIEF DESCRIPTION OF THE DRAWINGS

These and other objects and features of the present invention will become apparent from the following description taken in conjunction with preferred embodiments thereof with reference to the accompanying drawings, in which:

FIG. 2 is an exploded perspective view of the push-button switch of FIG. 1;

DESCRIPTION OF THE PREFERRED EMBODIMENTS

Figure 1:
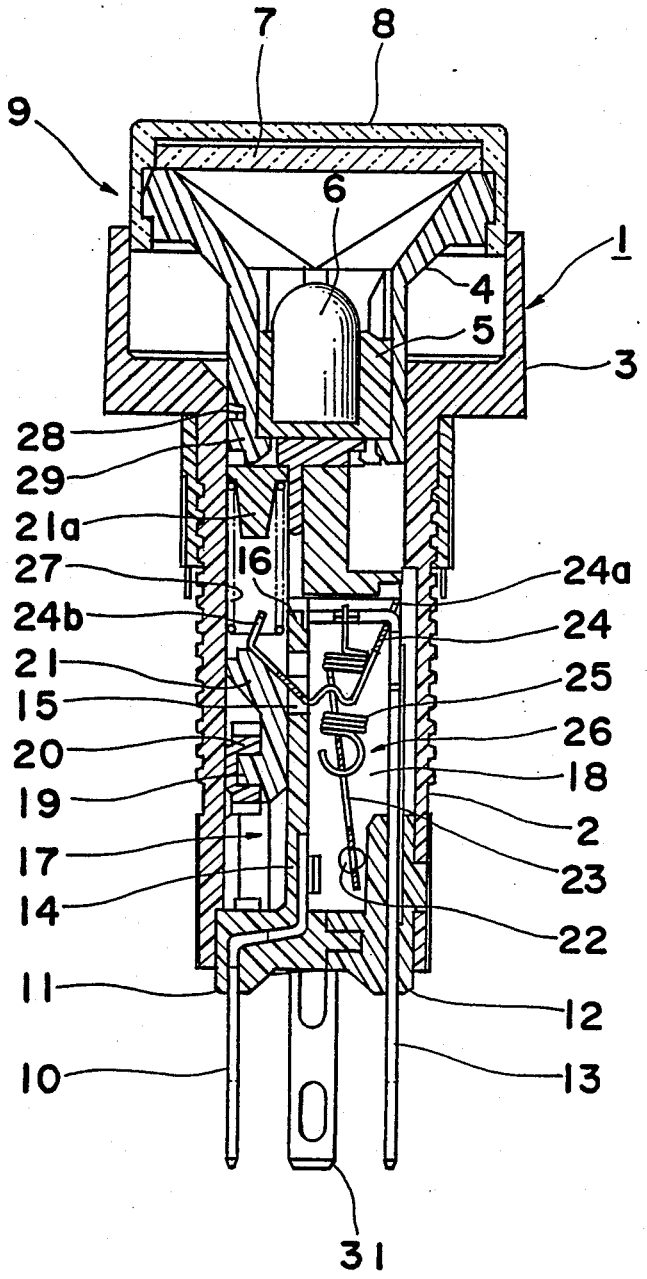
FIG. 1 is a cross sectional view of a push-button switch according to the present invention.

Before the description of the preferred embodiments of the present invention proceeds, it is to be noted that like parts are designated by like reference numerals throughout the accompanying drawings.

Referring now to the drawings, there is shown in FIGS. 1 and 2 a push-button switch of an illumination type according to the present invention. A housing 1 made of synthetic resin is composed of a lower part 2 in cylindrical configuration and an upper part 3 in square hollow configuration. The cylindrical part 2 is integrally formed with the square hollow part 3.

A light emitting diode 6 held by a holder 5 is placed at the lower part of a lamp casing 4 made of synthetic resin, while a covering 8 is fitted into the upper part of the casing 4 through a light diffusion disk 7.

It is to be noted that the LED 6 is one example of an illuminator, and it may be a lamp.

All of the above component parts 4 to 8 are formed into one unit 9 which is slidably mounted at an opening mouth at the top end of the housing 1.

In the meantime, there are accommodated in the cylindrical part 2, a first base 11 integrally formed with a terminal 10 and a second base 12 integrally formed with a fixed terminal 13 in an inversed L-shape.

The first base 11 has a partition wall 14 erected approximately at the center of the cylindrical part 2 so as to divide a switch member 26. This partition wall 14 is formed with a through-hole 15 for leading out an operating member 24 which will be described later to the side of a plunger 21. An upper end 13*a* of the fixed terminal 13 is engaged with a notched portion 16*a* in an L-shaped configuration of the frame 16.

Furthermore, the first base 11 is formed with grooves 37 at the opposite sides thereof such that the LED terminal 31 is fitted in the grooves. Moreover, the first base 11 has an insertion part 34 of a leading terminal 33 at the opposite sides on the top surface. While an aperture 35 formed on the LED terminal 31 is fitted into a projection 36 formed in the grooves 37, the LED terminal 31 is inserted into the insertion part 34 and then fitted into the cylindrical part 2.

The partition wall 14 divides the interior of the cylindrical part 2 into a plunger chamber 17 and a switch member chamber 18. In the plunger chamber 17, there is provided a plunger 21 slidably mounting an alternate cam 20 on a projected shaft 19. On the other hand, in the switch mechanism chamber 18, there is placed a switch member 26 which is composed of a movable member 23 having a contact point 22 formed at the free end portion thereof, an operating member 24 generally in a W-shaped configuration, and a coil spring 25.

In other words, the partition wall 14 is formed between the plunger 21 and the switch member 26.

Figure 3:
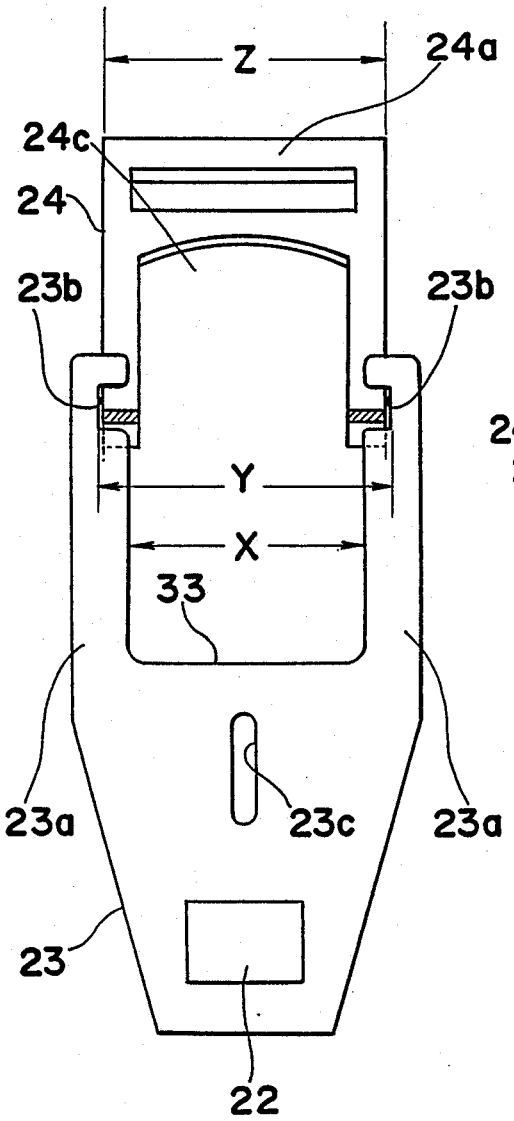
FIG. 3 is a view showing an essential portion of the switch on an enlarged scale.
Figure 4:
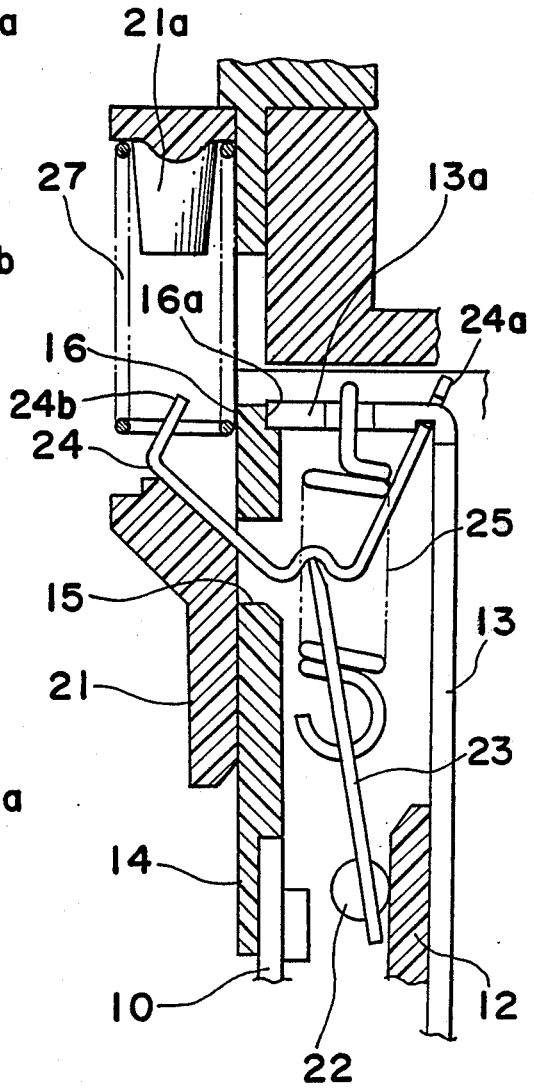
FIGS. 4 to 7 are cross sectional views of an essential portion of the switch, on an enlarged scale, respectively showing the condition of the returning operation thereof.

As shown in FIG. 3, the movable member 23 has two engagement plates 23*a* and 23*a* integrally formed therewith by a U-shaped notch 33 extending from the upper end towards the center thereof.

These engagement plates 23*a* and 23*a* are respectively formed at the inner peripheral surface thereof with engagement recesses 23*b* and 23*b* opposed to each other. The engagement recesses 23*b* and 23*b* are engaged with the external edge of the operating member 24.

Supposing that the distance between the inner faces of the engagement plates 23*a* and 23*a* is X, the distance between the outermost faces of the engagement recesses 23*b* and 23*b* is Y, and the distance between outer edges of the operating member 24 is Z, it is so arranged that an inequality $X<Z<Y$ is established.

One end 24*a* of the operating member 24 in generally W-shaped configuration is engaged with the inversed L-shaped terminal 13, and the engagement recesses 23*b* and 23*b* are engaged with the operating member 24 at the outer edge of the central part thereof, such that the operating member 24 is linked with the movable member 23. Then, a tension spring 25 which has its upper end hooked by the engagement portion 13*a* of the terminal 13 is passed through a central hole 24*c* of the operating member 24 in a downward direction. The lower ends of the tension spring 25 is hooked by a spring engagement hole 23*c* of the movable member 23.

Meanwhile, as described earlier, the central portion of the operating member 24 of which one end 24*a* is engaged with the inversed L-shaped terminal 13 extends, through the through-hole 15 into the plunger chamber 17. Between the other end 24*b* of the operating member 24 and a spring seat 21*a* above the plunger 21 is stretched a coil spring 27.

Moreover, an engagement member 28 at the upper end of the plunger 21 is engaged with a projected shaft 29 which is mounted on lamp casing 4, and accordingly, the plunger 21 is moved in association with the pressing operation of the unit 9. Therefore, plunger 21, shaft 19, cam 20 and engagement member 29 form a single unit, as shown in FIG. 2(*b*). When pressure is applied to covering 8, the pressure is transferred through lamp casing 4 to projected shaft 19 and to plunger 21. As plunger 21 slides along partition wall 14, cam 20 is guided along guide members 41, 42 and 43. Operation of cam 20 will be described later.

It is to be noted here that numerals 30 and 31 represent terminals for LED, and a numeral 32 represents a screw to be meshed with a screwing part in the outer periphery of the cylindrical part 2.

The push-button switch according to the present invention having the construction as described hereinabove will operate as follows.

When the unit 9 is pressed down, the plunger 21 is moved downward owing to the engagement between the engagement member 28 and the projected shaft 29. This downward movement of the plunger 21 is transmitted through the coil spring 27 to the operating member 24 which in turn swings in the counterclockwise direction in FIG. 1, with the one end 24*a* being a fixed point. At the same time, the alternate cam 20 is rotated half, maintaining the downward movement of the plunger 21.

Figure 5:
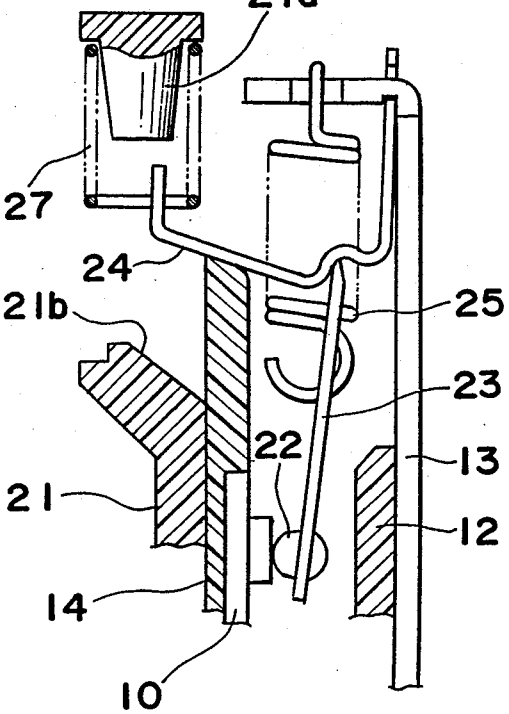

As a result, as shown in FIG. 5, the movable member 23 engaged with the tension spring 25 is inclined so as to press the contact point 22 against the terminal 10 opposite to the contact point 22. Thus, the push-button switch is turned from off state to on state, and the LED 6 starts to emit light. This condition is maintained by the alternate cam 20.

Figure 7:
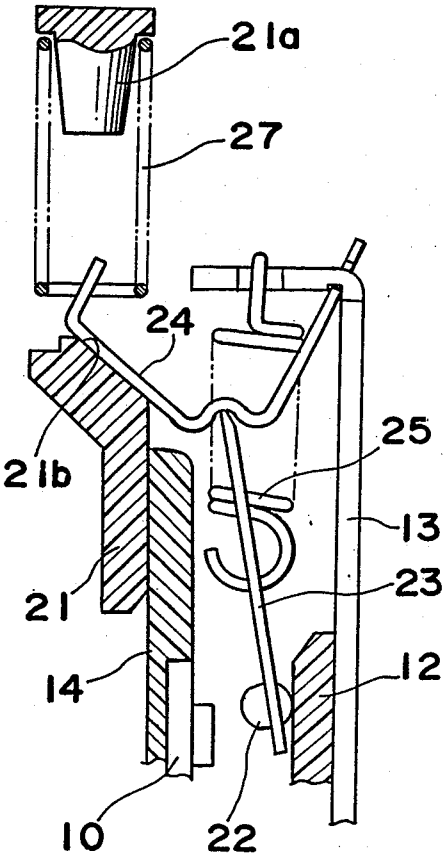

When the plunger 21 is to be returned from the depressed position shown in FIG. 5 upwards by moving the unit 9 again, the plunger 21 is returned by the spring force of the tension spring 25 and the coil spring 27. When the plunger 21 is returned by a predetermined stroke from the position shown in FIG. 5 to the position shown in FIG. 6, a compulsory returning member 21*b* of a tapered configuration and integral with the plunger 21 is brouht into contact against the bottom face of the operating member 24 which is in turn forcibly displaced so as to be brought into the condition shown in FIG. 7 from the condition of FIG. 6, with the movable member 23 being inclined to turn off the switch.

Figure 6:
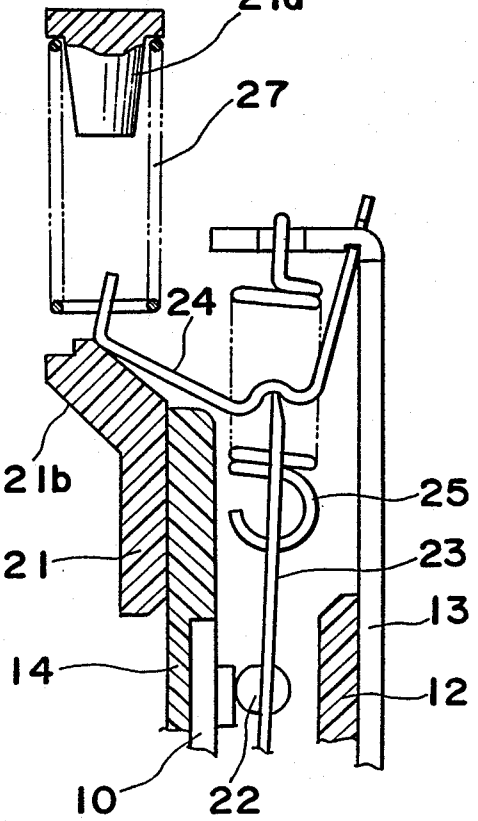

In the manner as described hereinabove, since the compulsory returning member 21*b* which is integrally formed with the plunger 21 forcibly moves the operating member 24 when the plunger is returned to the predetermined position shown in FIG. 6, the operating member 24 can be prevented from returning to a different position other than the predetermined position or improperly returning to the predetermined position. Therefore, it is advantageous that the operating member 24 can be securely returned at a predetermined stroke position.

Under the circumstances as described above, when the unit 9 is depressed again, the push-button switch is turned off from on, displaying the state shown in FIG. 1.

Figure 8:
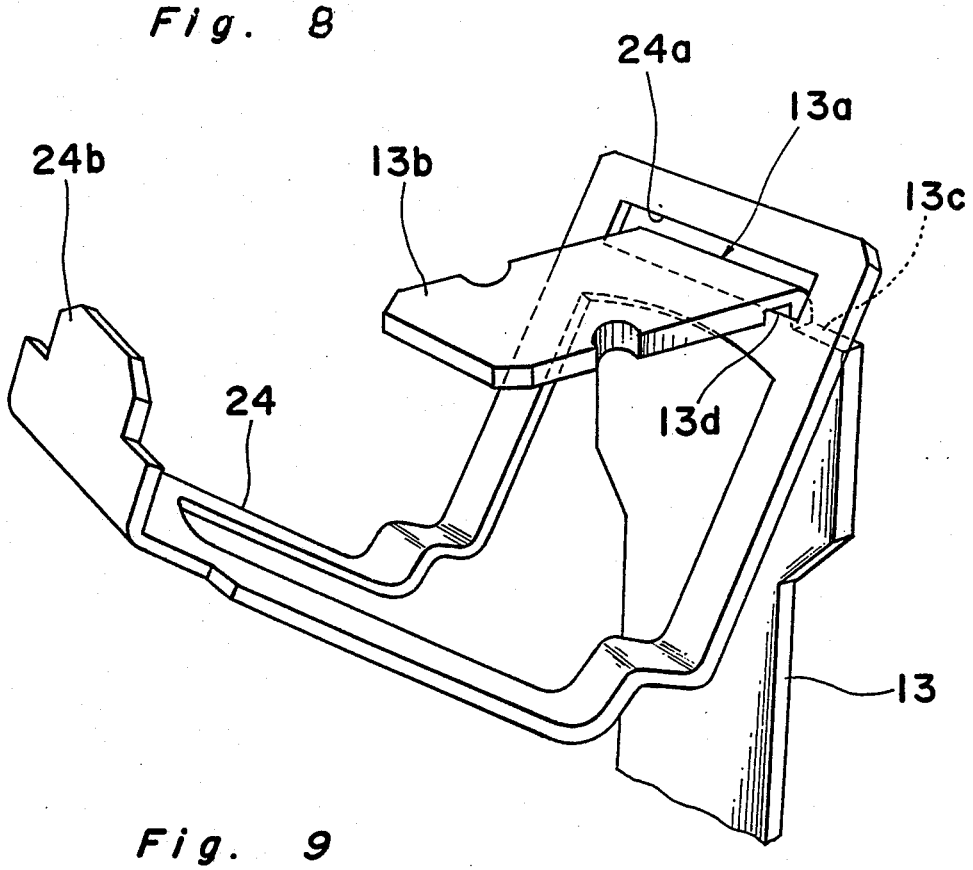
FIGS. 8 and 9 are perspective views of an essential portion of the switch, on an enlarged scale.
Figure 9:
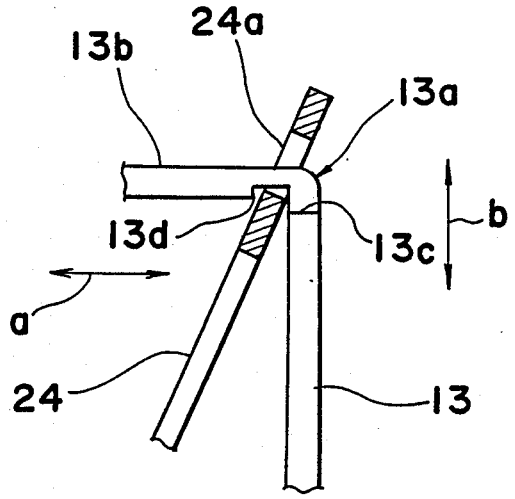

In the meantime, during the assembly of the above push-button switch, when the operating member 24 is brought into mesh with the curved corner position 13*a* of the inversed L-shaped fixed terminal 13 through the through-hole 24*a* at the right end of the operating member 24 as shown in FIGS. 8 and 9, the lower side edge of the through-hole 24*a* is pressed into contact with the notched groove 13*d* of the fixed terminal 13, thereby preventing the operating member 24 from being disengaged from the fixed terminal in the forward direction or in the rearward direction (in the direction shown by an arrow a in FIG. 9) and, at the same time and moreover, the opposite side edges of the through-hole 24*a* are also pressed into contact with the shouldered portions 13*c* and 13*c* of the fixed terminal 13, respectively, thereby preventing the operating member 24 from being disengaged from the fixed terminal in the upward direction or in the downward direction (in the direction shown by an arrow b in FIG. 9).

Accordingly, while the spring force of the tension spring 25 is added to the operating member 24 during the temporary assembling time of the push-button switch, this spring force presses the operating member 24 against the curved corner portion 13*a*, which results in the prevention of the disengagement of the operating member in the forward direction or in the rearward direction owing to the contact with the shouldered portions 13*c* and 13*c*. Thus, the operating member 24 is never separated from the fixed terminal 13 during the assembling time of the switching mechanism 26, and therefore, the assembly of the push-button switch is effectively rendered smooth. In addition, since it is so arranged in accordance with the present invention that the edge of the through-hole 24*a* formed at one end of the operating member 24 is meshed with the curved corner portion 13*a* of the fixed terminal 13, it is advantageous that there is no need for a special engaging member for engaging fixed terminal 13 with operating member 24 to be provided within the push-button switch of the present invention, although it is required in the prior art push-button switch.

Figure 10:
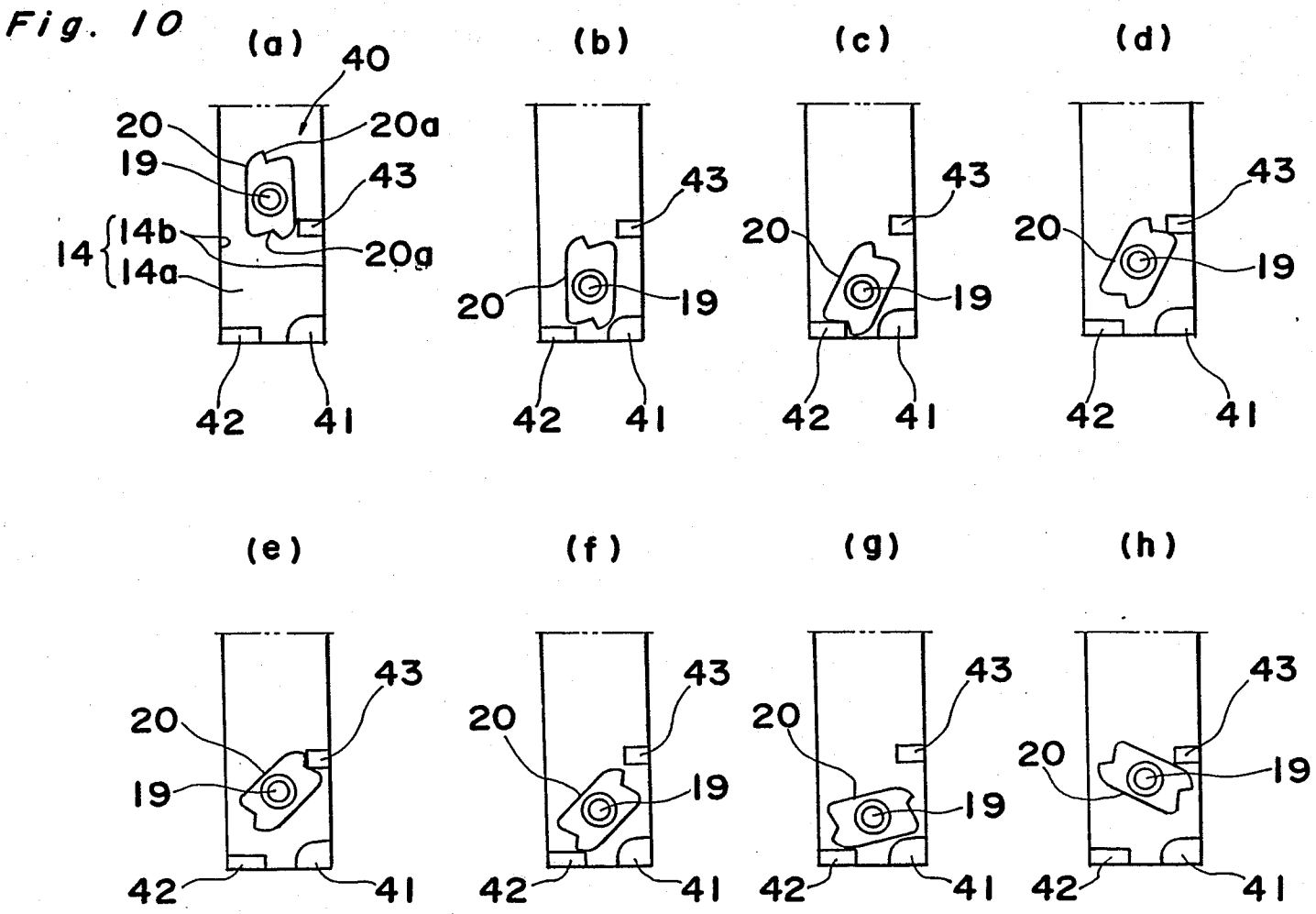
FIG. 10 is a view explanatory of the operation of an alternate cam member.

In general, the alternate cam 20 of the alternate cam member 40 is held, as shown in FIG. 10(*a*), in a longitudinal configuration and its rotation around a shaft 19 is restricted by the side edges 14*b* and 14*b*. Upon depression of the illumination unit 9, the plunger 21 is moved downwards in association with the engagement between the projected shaft 29 and the engagement member 28. The force of this downward movement of the plunger 21 is transmitted through the coil spring 27 to the operating member 24, and therefore, the operating member 24 swings in the counterclockwise direction of FIG. 1, with one end thereof 24*a* being a fulcrum. Then, the movable member 23 engaged with the tension spring 25 is inclined and the contact point 22 at the lower end of the movable member 23 comes into pressed contact with the opposite terminal 10, such that the push-button switch is turned on from off, and the LED 6 generates light.

As shown in FIGS. 10(*b*) and 10(*c*), when the alternate cam 20 is moved downwards in association with the downward movement of the plunger 21, the alternate cam 20 is in contact with the first guide 41 to be inclined such that the cam groove 20*a* is meshed with the second guide 42, thus limiting the downward movement of the plunger 21.

Thereafter, when the depression of the illumination unit is released, the alternate cam 20 together with the plunger 21 is slightly moved upwards as shown in FIGS. 10(*d*) and 10(*e*), with the cam groove 20*a* being meshed with the intermediate third guide 43. Thus, the plunger 21 is locked in the depressed state.

Then, when the illumination unit is again depressed, the alternate cam 20 is contacted with the second guide 42, as shown in FIG. 10(*f*), due to the downward movement of the plunger 21. The alternate cam 20 is then inclined to lie as shown in FIG. 10(*g*), thereby a further depression of the plunger 21 being restricted.

Next, by releasing the depressing force of the illumination unit, the plunger 21 is returned upwards as shown in FIG. 10(*h*), and then the side face of the alternate cam 20 is rotated half by the third guide 43. The alternate cam 20 is returned back to the condition shown in FIG. 10(*a*). Simultaneously, the push-button switch is switched from on to off to be in the state shown in FIG. 1.

Since the first, second and third guides 41, 42 and 43 are integrally formed on partition wall 14, and the three guides 41, 42 and 43 and the plunger 21 are constructed with high accuracy in size, the movement of the alternate cam 20 having the construction as described above can be rendered smooth and secure.

The lamp casing 4 made of synthetic resin is equipped with the LED 6 supported by the holder 5 at the lower portion thereof, having the covering 8 fitted into the upper portion thereof through the light diffusion disk 7.

The above component parts 4 and 8 are formed into one unit 9 so to be slidably provided at the upper opening of the housing 1.

Figure 11:
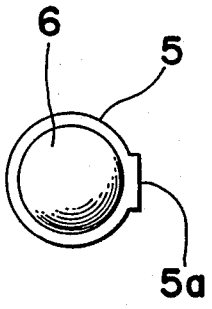
FIG. 11 is a plan view of a lamp holder having an LED fitted therein.

As shown in FIG. 11, a single columnar projection 5*a* is formed on the outer peripheral surface of the cylindrical lamp holder 5 which has the LED 6 accommodated therein.

Figure 12:
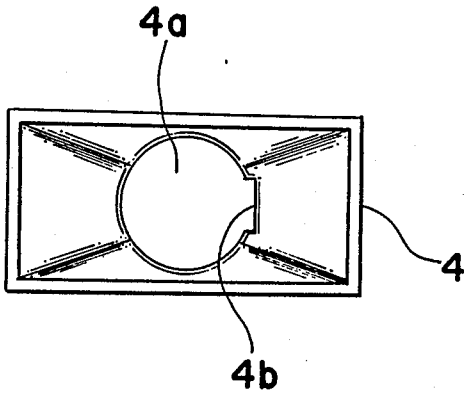
FIG. 12 is a plan view of a lamp casing.

Moreover, as shown in FIG. 12, a single grooved recess 4*b* is formed, corresponding to the above projection 5*a*, in the inner surface of a lamp receiving part 4*a* of the lamp casing 4 which accomodates the lamp holder 5 therein.

Figure 13:
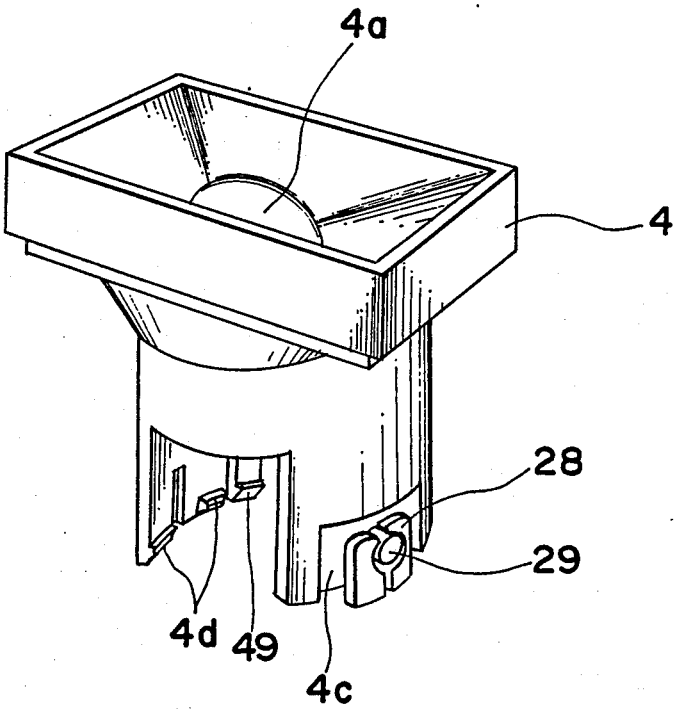
FIG. 13 is a perspective view showing the condition of the engagement between the lamp casing and the one end of a plunger.

Referring further to FIG. 13, the outer surface at the lower portion of the lamp casing 4 is partially hollowed so as to form a hollow 4*c* with which is integrally formed the projected shaft 29 extending outwardly. This projected shaft 29 is engaged with the horn-like engaging member 28 at the upper end of the plunger 21.

Moreover, in the inner surface at the lower portion of the lamp casing 4, there is provided a claw-shaped engaging portion 4*d* which is secured to the bottom of the lamp holder 5.

In the assembly of the push-button switch, after the lamp casing 4 and the lamp holder 5 are assembled such that the projection 5*a* on the outer peripheral surface of the holder 5 corresponds to the recessed portion 4*b* on the inner surface of the lamp casing 4, when the engagement member 28 at the upper end of the plunger 21 is engaged with the projected shaft 29, the direction of the assembly of the lamp holder 5 with respect to the lamp casing 4 and, that of the lamp casing 4 with respect to the plunger 21 are controlled respectively by the engagement between the projection 5*a* and the recess 4*b* and, that between the projected shaft 29 and the engaging member 28. As a result, the LED 6 having polarity can be securely inserted into a predetermined direction, prevented from being improperly inserted.

Figure 14:
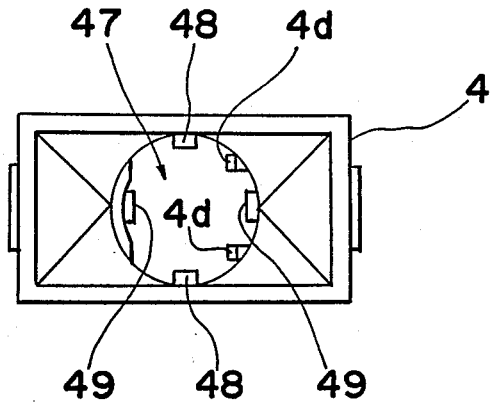
FIG. 14 is a plan view of a lamp casing.
Figure 15:
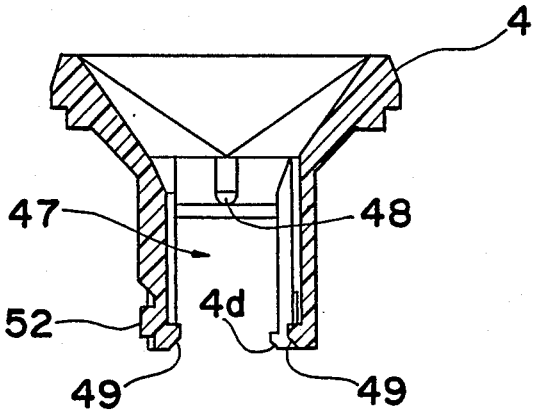
FIG. 15 is a vertical cross sectional view of the lamp casing of FIG. 14.
Figure 16:
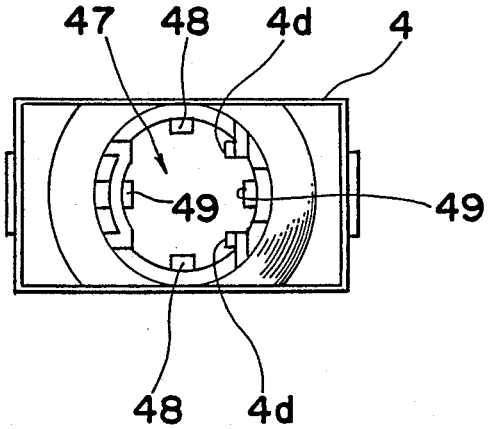
FIG. 16 is a bottom plan view of the lamp casing of FIG. 14.

On the other hand, the lamp casing 4 is formed with a holder receiver 47 inside thereof which corresponds to the lamp holder 5, as shown in FIGS. 14 to 16. The holder receiver 47 is integrally formed with two engagement projections 48 and 48 which correspond to U-shaped grooves 46*a* of U-shaped projections 46.

At the lower end of the lamp casing 4, an engagement claw 49 to be engaged to the bottom face of the lamp holder 5 and an engagement claw 4*d* to be engaged with the lateral frame 50 of the housing 1 are respectively integrally formed with the casing 4, both extending inwardly.

In the housing 1, the lateral frame 50 is attached to the upper interior of the cylindrical part 2, with forked engaging portions 51 and 51 being integrally formed therewith so as to correspond to the U-shaped projections 46 and 46 formed in the outer periphery of the lamp holder 5. It is so arranged that the U-shaped projection 46 is caught by the engaging portion 51 from opposite sides thereof.

Meanwhile, the assembly of the illumination unit 9 and the housing 1 will be described now with reference to FIGS. 17 to 19. First, the holder 5 holding the LED 6 inside thereof is inserted in the holder receiver 47 of the lamp casing 4, which lamp casing is fitted with the covering 8 through the light diffusion disk 7.

Figure 17:
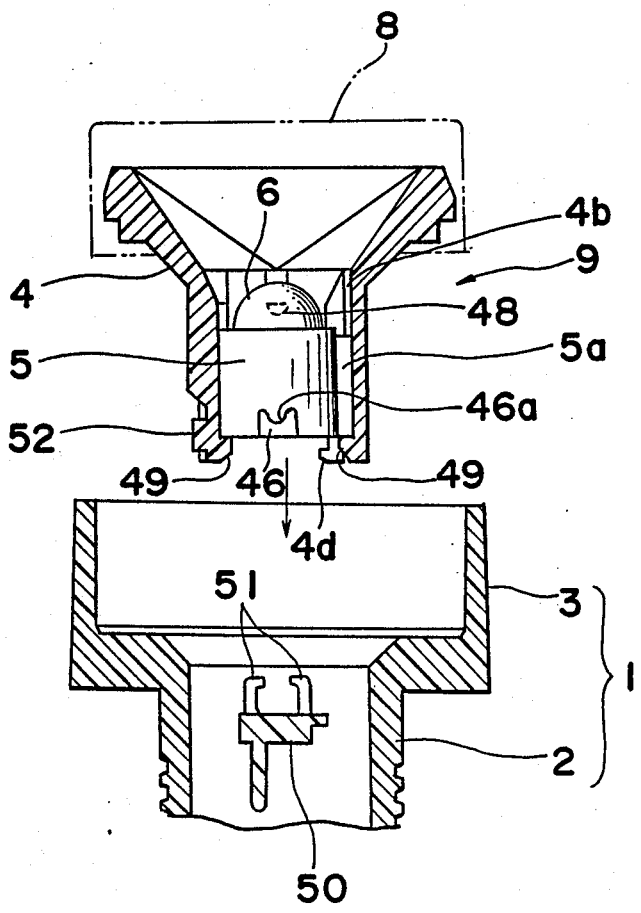
FIG. 17 is an exploded cross sectional view of an illumination unit and a housing.
Figure 18:
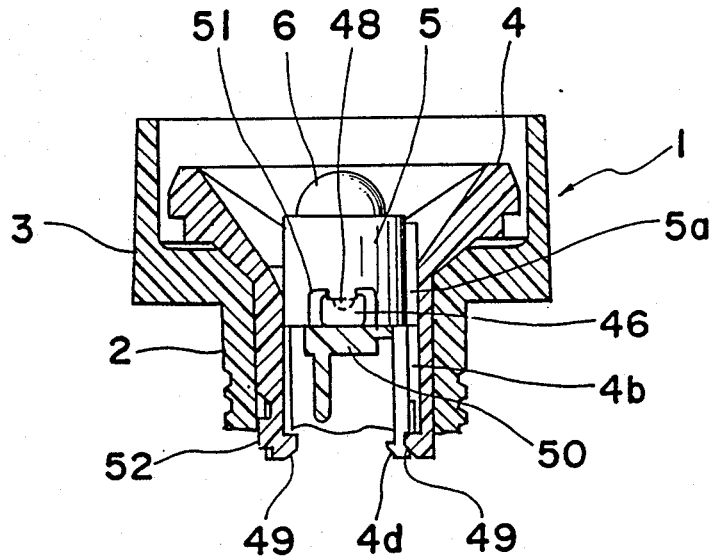
FIG. 18 is a cross sectional view showing the assembling process of the illumination unit and the housing of FIG. 17.

As shown in FIG. 17, when the illumination unit 9 is inserted through the upper opening of the housing 1 in the direction shown by an arrow, the bottom face of the holder 5 comes into contact with the lateral frame 50 of the housing 1, and accordingly the holder 5 is moved upwards within the lamp casing 4 while it holds the LED 6 inside thereof.

Thus, as the lamp holder 5 is moved upwards within the lamp casing 4 in the manner as described above, the U-shaped projection 46 on the outer peripheral surface of the lamp holder 5 is brought into contact with the engaging projection 48 within the lamp casing 4. Then, as shown in FIG. 18, at the time when the engaging projection 48 is in meshed relation with the groove 46*a* of the U-shaped projection 46, the upward movement of the lamp holder 5 is prevented.

When the lamp holder 5 is stopped as described above, the forked engaging portions 51 integrally formed with the lateral frame 50 secures the U-shaped projection 46 in such a manner as to sandwich the same from opposite sides thereof.

Figure 19:
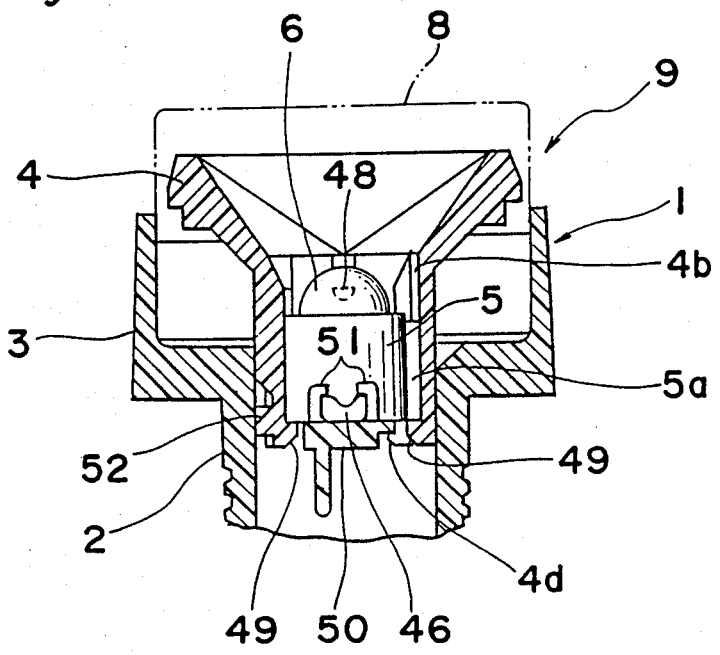
FIG. 19 is a cross sectional view showing the state of the illumination unit and the housing of FIG. 17 when they are completely assembled.

Subsequently, after the illumination unit 9 is pushed by a predetermined stroke owing to the spring force of the spring to the push-button switch inner mechanism described later, the engagement claw 49 at the lower part of the lamp casing 4 is engaged with the bottom of the lamp holder 5, as shown in FIG. 19, while the engagement claw 4*d* is engaged with the lateral frame 50. Accordingly, the illumination unit 9 is secured to the opening of the housing 1 at the upper end thereof with a given depressing stroke.

In the manner as described hereinabove, since it is so arranged that the U-shaped projection 46 on the outer peripheral surface of the lamp holder 5 is engaged with the engaging projection 48 within the lamp casing 4, the upward movement of the lamp holder 5 is controlled. Moreover, while the upward movement of the lamp holder 5 is controlled, the forked engaging portions 51 are engaged with the U-shaped projection 46 from below, namely, from the side contrary to the side where the U-shaped projection 46 is engaged with the engaging projection 48, thereby realizing the assembly of the push-button switch without the use of any particular tool therefor such as a pair of pincers or the like.

In addition, in the case where the illumination unit 9 is to be detached, if the lamp casing 4 is pulled up in a direction opposite to the direction of the arrow in FIG. 17, the engaging portion 51 of the housing 1 is desengaged from the U-shaped projection 46 because of the elasticity change peculiar to the synthetic resin, and at the same time, the engagement claws 49 and 49 at the lower end of the lamp casing 4 are drawn up while being secured to the lamp holder 5. Accordingly, the push-button switch can be advantageously disassembled without the use of any particular tool therefor, in the same manner as in the assembling time.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A push-button switch, comprising (a) a lamp portion, including a lamp, a lamp holder, a projection formed on said lamp holder, a lamp casing surrounding said lamp holder, and movable between a first position and a second position, a housing surrounding said lamp casing, a lateral frame formed on said housing for engaging said projection on said lamp holder, and (b) a switch portion, including a plunger that is engaged with said lamp casing and is movable in conjunction with said lamp casing, and a switch member that is engaged with said plunger and is movable in conjunction with said lamp casing and said plunger, wherein when said lamp casing is in said first position said switch member creates an electric circuit and when said lamp casing is in said second position said switch member breaks said electric circuit, and further comprising a projected shaft formed on said lamp casing and an engagement member formed on said plunger for engaging said projected shaft.

2. The push-button switch of claim 1 wherein said lateral frame has a forked engagement portion for surrounding said projection.

3. The push-button switch of claim 1, wherein said lamp casing has a bottom surface and said lamp holder has a bottom surface, and wherein engagement claws are formed on said bottom surface of said lamp casing for engaging said bottom surface of said lamp holder when said lamp casing is in said first position.

4. The push-button switch of claim 1 wherein said lamp holder is shaped such that it can be inserted within said lamp casing in only one position.

5. A push-button switch, comprising (a) a lamp portion, including a lamp, a lamp holder, a projection formed on said lamp holder, a lamp casing surrounding said lamp holder, and movable between a first position and a second position, a housing surrounding said lamp casing, a lateral frame formed on said housing for engaging said projection on said lamp holder, and (b) a switch portion, including a plunger that is engaged with said lamp casing and is movable in conjunction with said lamp casing, and a switch member that is engaged with said plunger and is movable in conjunction with said lamp casing and said plunger, wherein when said lamp casing is in said first position said switch member creates an electric circuit and when said lamp casing is in said second position said switch member breaks said electric circuit, and further comprising an engaging projection formed on said lamp casing for engaging said projection on said lamp holder when said lamp casing is in said second position and disengaging from said projection on said lamp holder when said lamp casing is in said first position.

* * * * *